US005211458A

United States Patent [19]

Yale

[11] Patent Number: 5,211,458

[45] Date of Patent: May 18, 1993

[54] RIBBED MAT FOR PLACEMENT ON BOTTOM OF FILE CABINET DRAWER TO PREVENT DOCUMENT SLIPPAGE

[76] Inventor: William S. Yale, Box 668, Yorba Linda, Calif. 92686

[21] Appl. No.: 922,503

[22] Filed: Jul. 31, 1992

[51] Int. Cl.[5] ..... A47B 63/00

[52] U.S. Cl. ..... 312/193; 312/348.5; 283/74; 283/95; 283/114; 283/117; 248/909; 211/126

[58] Field of Search ..... 312/183, 185, 193, 348.3, 312/348.5, 901; 283/72, 81, 74, 114, 117, 95; 40/371, 373; 248/909, 633, 632; 211/126

[56] References Cited

U.S. PATENT DOCUMENTS

| | | | |
|---|---|---|---|
| 2,534,137 | 12/1950 | Lewis | 248/633 |
| 3,176,849 | 4/1965 | Peebles . | |
| 3,224,824 | 12/1965 | Remke | 312/183 |
| 4,105,270 | 8/1978 | Bergkamp | 312/193 |
| 4,164,309 | 8/1979 | Staats | 312/193 |
| 4,241,921 | 12/1980 | Miller . | |
| 4,837,061 | 6/1989 | Smits | 283/81 |
| 4,986,499 | 1/1991 | Ponticelli | 248/909 |

FOREIGN PATENT DOCUMENTS

| | | | |
|---|---|---|---|
| 681976 | 9/1939 | Fed. Rep. of Germany | 40/371 |
| 686173 | 12/1939 | Fed. Rep. of Germany | 312/183 |

*Primary Examiner*—Peter M. Cuomo
*Assistant Examiner*—Flemming Saether
*Attorney, Agent, or Firm*—Eli Lieberman

[57] ABSTRACT

A soft mat for placement on the bottom of a file cabinet drawer to maintain the stored files in an orderly upright position. The upper surface of the mat is provided with a series of spaced, parallel ridges defining grooves which receive edge portions of the files.

14 Claims, 8 Drawing Sheets

FIG. 8
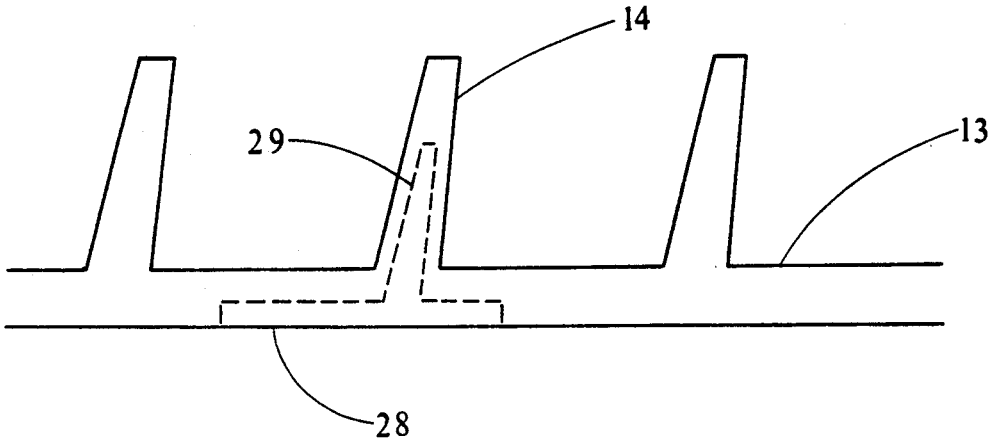
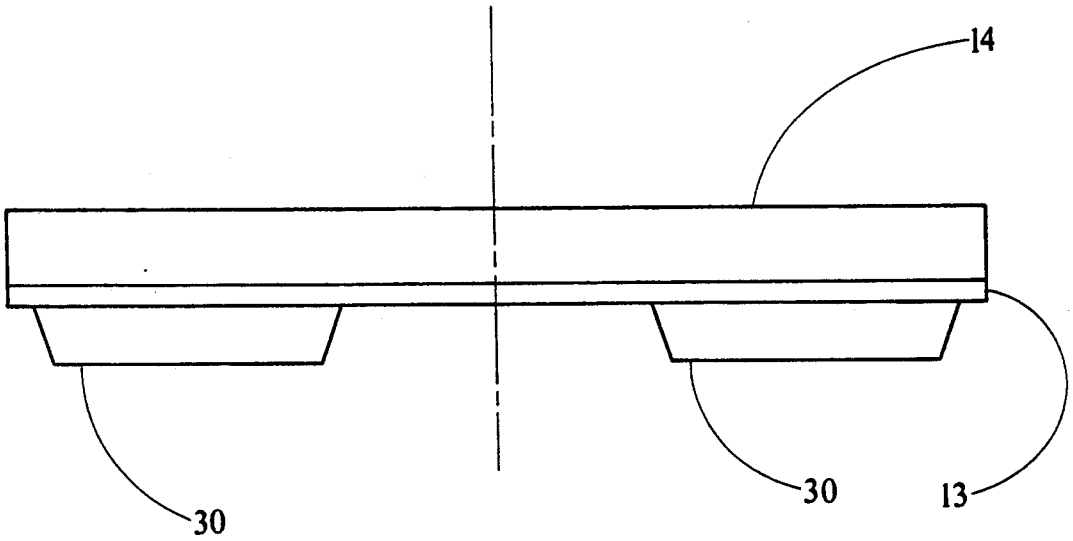
FIG. 9

RIBBED MAT FOR PLACEMENT ON BOTTOM OF FILE CABINET DRAWER TO PREVENT DOCUMENT SLIPPAGE

BACKGROUND OF THE INVENTION

This invention relates to an insertion to be placed on the bottom of a file cabinet drawer to maintain the stored files in an orderly fashion. Files initially stored in a neat upright position in a file cabinet have a tendency to bend and slip under each other over a period of time making retrieval of the files difficult. The problem is frequently encountered in the use of manila file folders. As the folders age or become overstuffed with papers they lose their stiffness and begin to settle and creep under their own weight along the bottom of the drawer. The file settling problem is aggravated by vibrations generated from the floor and from opening and closing the file cabinet.

It is known to provide a file cabinet drawer with a sliding metal stop plate which can be moved forward to abut and compress the stack of files. This expedient does help but has certain drawbacks. For example, a user will release the stop plate to retrieve a file and then forget to reset it. Also, with the stop plate in position compressing the files some difficulty may be experienced in removing a selected file.

A number of devices for supporting files have been invented as typified by David M. Peebles U.S. Pat. No. 3,176,849, issued Apr. 6, 1965 and David R. Miller U.S. Pat. No. 4,241,921, issued Dec. 30, 1980. The patent to peebles shows a wire rack which can be mounted on the bottom of a file cabinet drawer to maintain the files in a generally vertical position. Miller shows a separate container for cards wherein transverse grooves are placed along the floor of the container to prevent slippage of the cards in the drawer.

While the prior art discussed above addresses the problem of file storage, the prior art does not teach a file retainer for a file cabinet drawer having the flexibility of installation, the wide application and the feature of adjustability found in the instant invention.

SUMMARY OF THE INVENTION

The overall object of the present invention is to provide a ribbed retaining structure on the bottom of a file cabinet drawer to prevent file slippage. The retaining structure can cover the entire bottom of the drawer or only a portion thereof.

It is a specific object of the invention to provide a ribbed plastic retaining mat which can be cut to fit the bottom of any file cabinet drawer.

It is another object of the invention to provide score lines on the mat to aid in the fitting operation.

It is yet another object of the invention to provide attachments which lock onto the ribbed structure to aid in supporting the files.

BRIEF DESCRIPTION OF THE DRAWINGS

FIG. 8 illustrates the use of a stiffening insert for the ribs;

FIG. 9 illustrates the use of longitudinal bottom ridges to adapt the mat for file drawers whose bottom surfaces are of irregular pattern and not planar;

DESCRIPTION OF THE PREFERRED EMBODIMENTS

Figure 1:
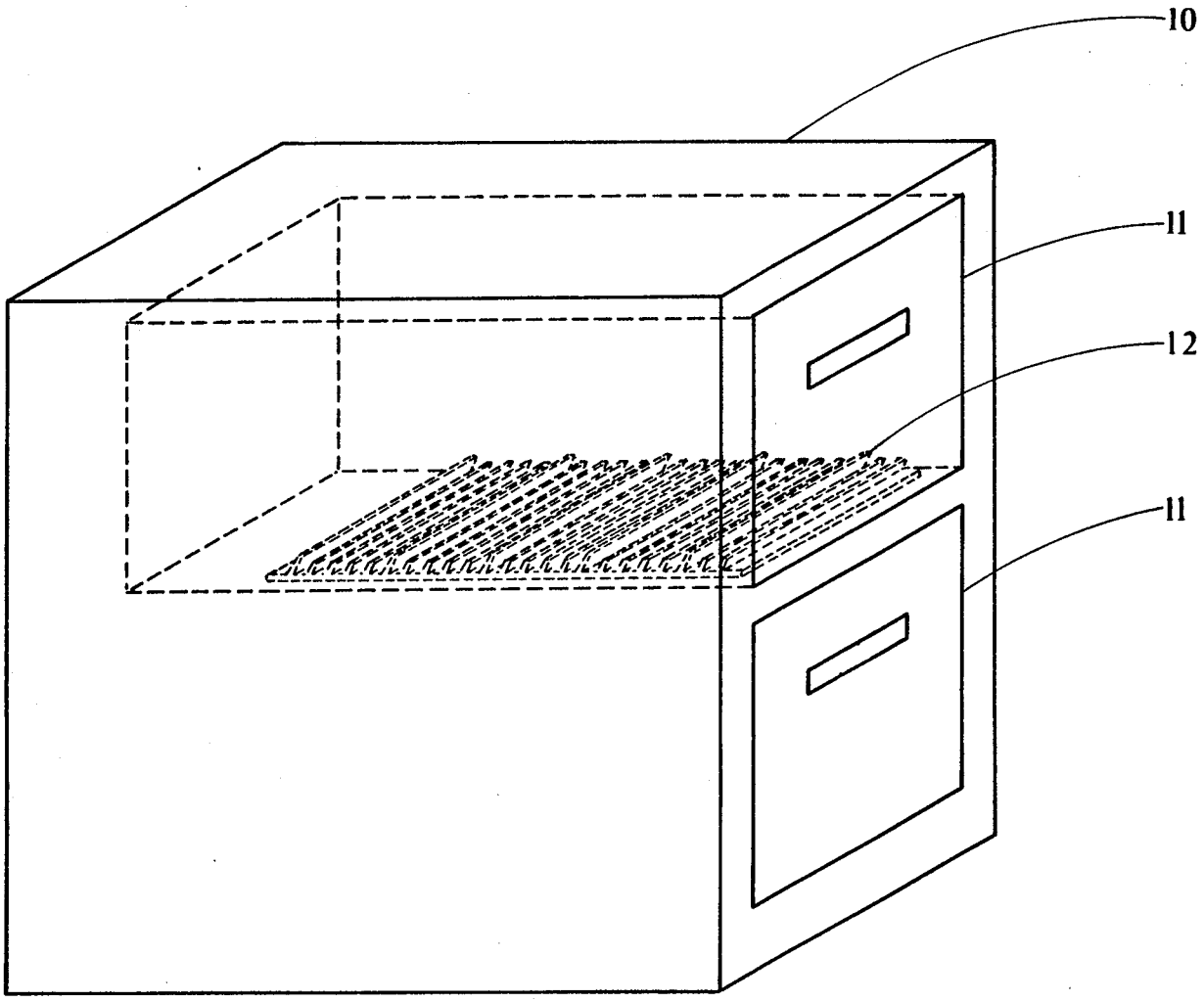
FIG. 1 is an isometric view showing a file cabinet with the file mat in position on the bottom of the drawer.
Figure 2:
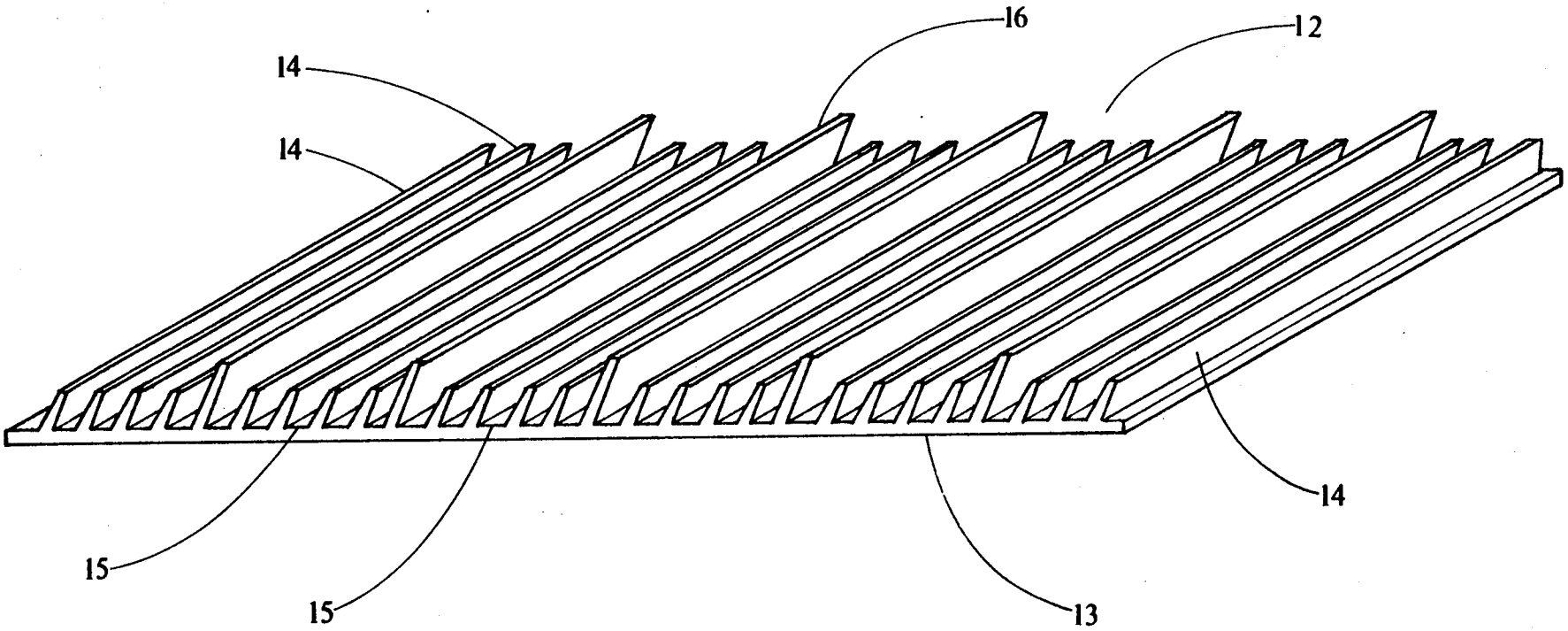
FIG. 2 is a view showing the file mat of FIG. 1 in greater detail.

Referring now in general to the drawing and in particular to FIGS. 1 and 2, a typical filing cabinet 10 is shown with two sliding doors 11. The file holding mat 12 of this invention is shown in phantom mounted on the bottom of the upper sliding door. The mat is shown in detail in FIG. 2 and comprises a generally flat pliant sheet 13 of plastic with a plurality of spaced primary ridges 14 on the upper surface. The ridges 14 are slightly angled in the direction of the front of the cabinet. The space 15 between each pair of ridges provides a valley to receive the closed end of a manilla folder or the free edge of an individually filed document. Larger or firmer ridges 16 may be interspersed with the primary ridges 14 to facilitate separation of desired folder groups. The larger ridges 16 may be integrally molded along with the primary ridges 14 or may be formed by U-shaped extension ridges clipped onto the primary ridges at selected locations.

The material used for the mat must be of a soft, pliant plastic with a large coefficient of sliding friction to prevent slippage along the bottom of the drawer and to aid in retaining the files between the ridges. The depth of the ridges, the inclination and spacing are all noncritical features arrived at through an optimization to fit the needs of a typical office. These features could be varied, of course, to fit any special needs.

Figure 4:
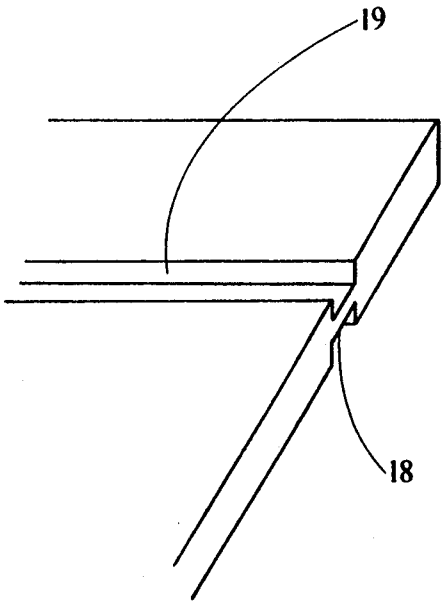
FIG. 4 is a detailed view of a cutting groove.
Figure 3:
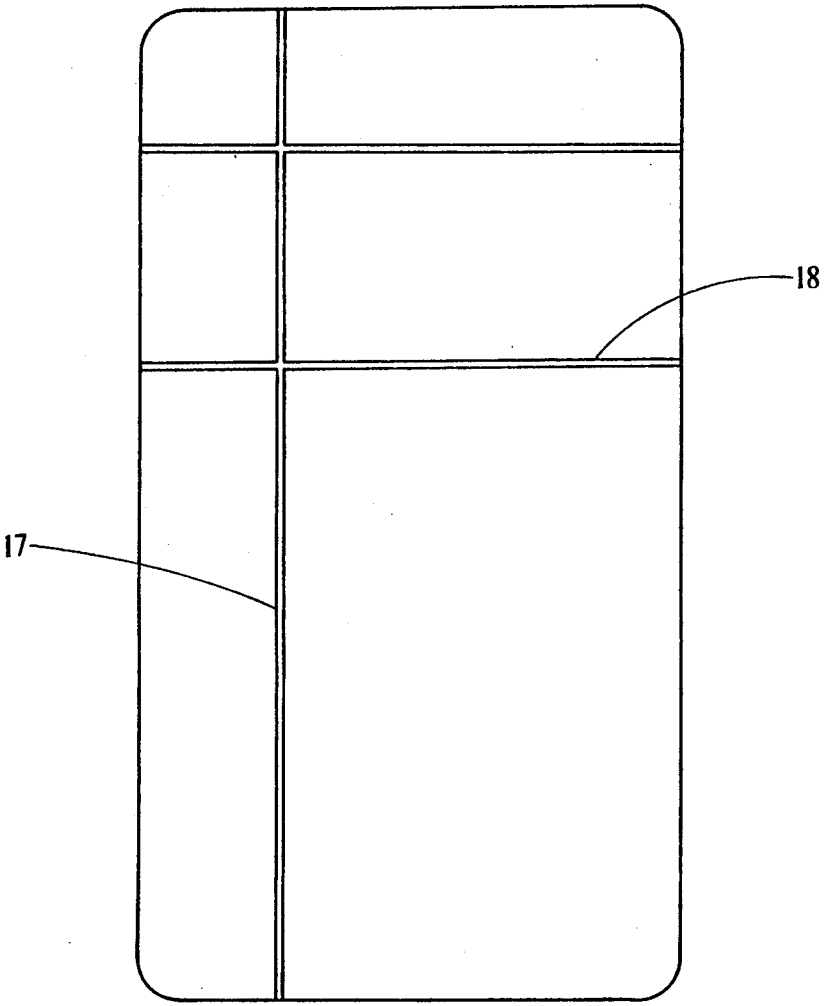
FIG. 3 is a bottom view of the file mat showing a pattern of cutting grooves.

FIGS. 3 and 4 illustrate grooves or score lines provided on the file holding mat to easily adapt the mat for file cabinet drawers of differing sizes. FIG. 3 is a bottom view of the mat showing a pattern of longitudinal 17 and transverse 18 score lines provided to facilitate cutting of the mat with scissors or other sharp objects or simply by tearing to fit the mat to a file cabinet drawer. The longitudinal score lines 17 reduce a legal sized wide mat to fit drawers of lesser width. Transverse score lines 18 reduce the mat to fit drawers of lesser depth. Additional score lines may be present to provide mat shaping for special applications FIG. 4 is an enlarged view of a cutting groove 18 as seen from the edge of the mat. A depression 19 may be present on the upper surface of the mat directly in opposition to the grooves 18 on the contact side of the mat. The intervening material is sufficiently thick to keep the mat from tearing unless a break in it is initiated with a cutting object. The intervening material is thicker at the edge of the mat to prevent accidental tearing of the mat during handling. The opposed grooves 18 and 19 are situated between ridges 14 not shown in FIG. 4. Depressions similar to 19 may be provided on the upper surface of the mat opposed to longitudinal score lines 17. These depressions may run between the ridges but may also include ridge portions, if desired.

Figure 5:
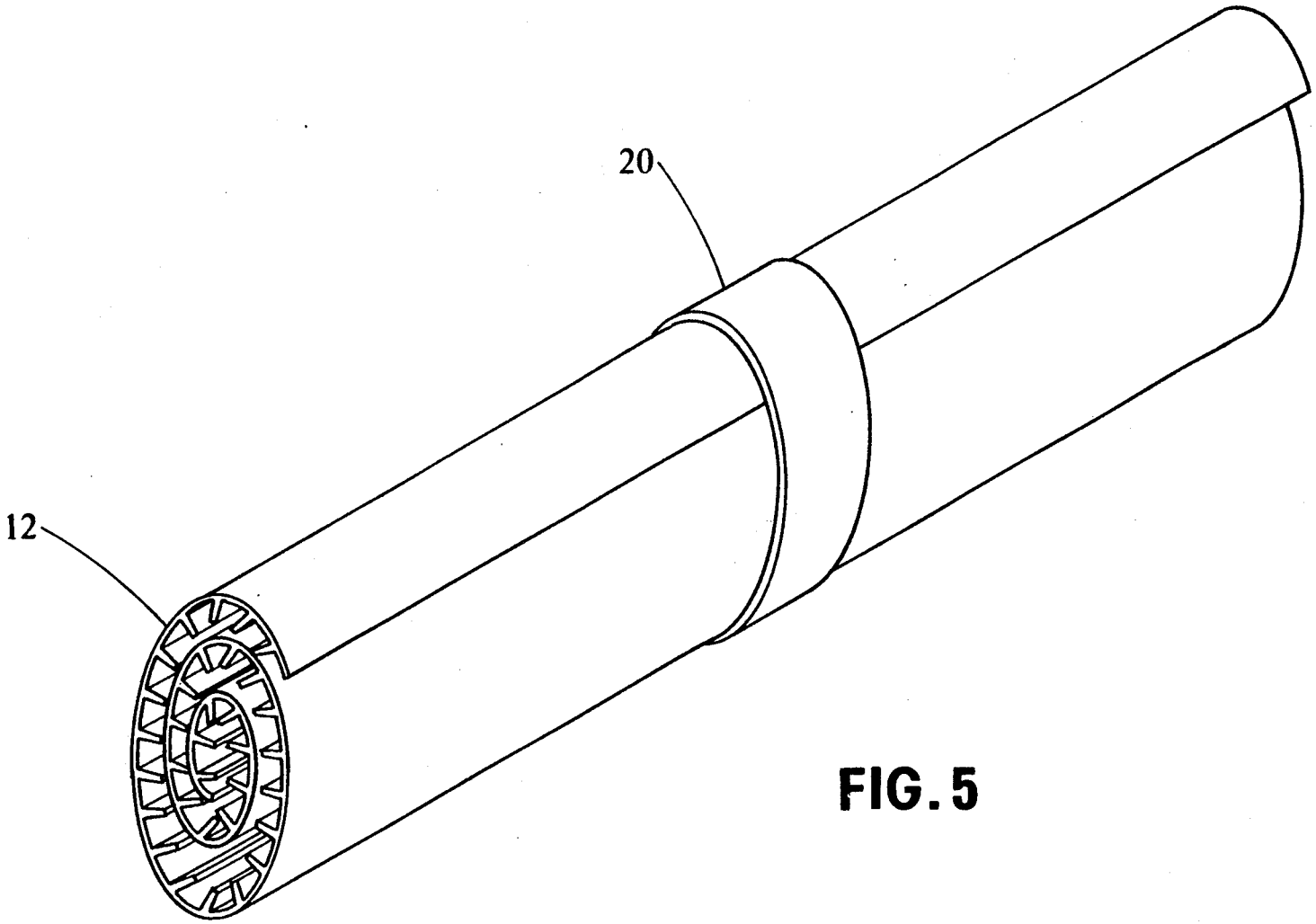
FIG. 5 is a view of the mat in a rolled condition for storage.

FIG. 5 shows the mat of FIG. 2 in a rolled up position for shipment or storage. A band 20 keeps the mat from unravelling. Other modifications described below can also be shipped and stored in a rolled up manner.

Figure 6:
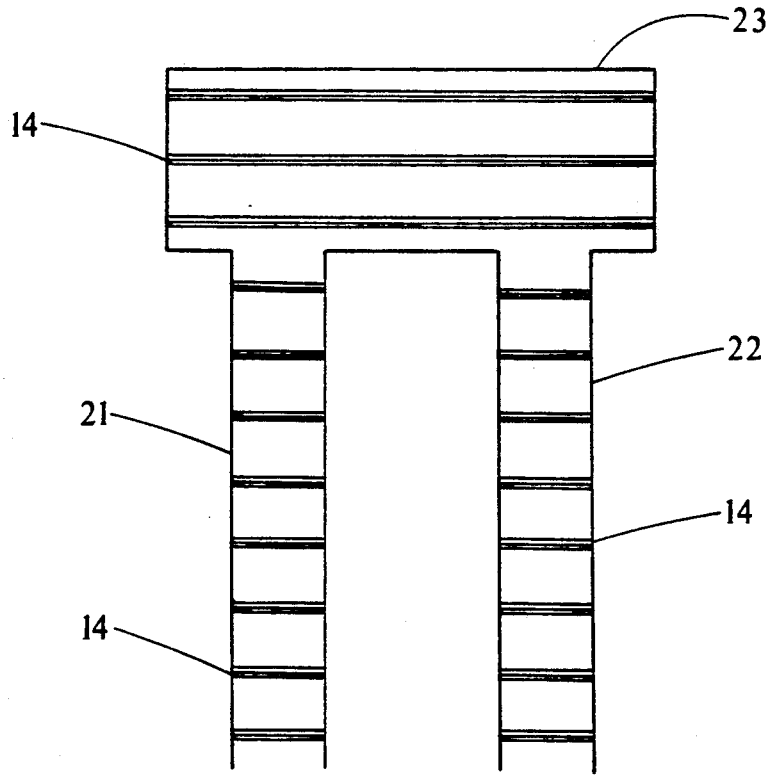
FIG. 6 is a modification which does not completely cover the bottom of the drawer.

FIG. 6 shows a modification of the invention employing an open construction to save material and to reduce weight. The mat of FIG. 1 which covers the entire bottom of the drawer is approximated by means of a pair of parallel strips 21 and 22. The strips are provided with aligned ridges 14 similar to the ridges 14 in FIG. 1. The parallel strips 21 and 22 may be joined by a transverse bridging structure 23 situated at the back end of the drawer. The bridging structure also contains ridges 14 to support a backstop. The number of strips employed, their relative spacings, and the location of the bridging structure may all be varied under the disclosure to suit specific applications.

Figure 7:
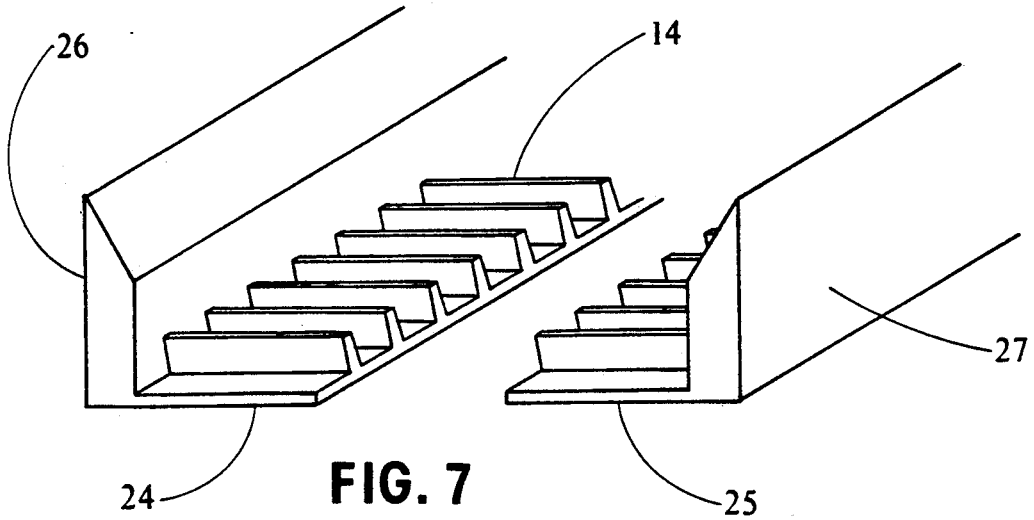
FIG. 7 is a modification showing a two piece mat.

FIG. 7 is another modification of the mat consisting of two symmetrical right angled strips 24, 25 placed longitudinally at the side portions of the drawer with upstanding sides 26 and 27 contacting the sides of the drawer. Transverse ridges 14 are present on the horizontal portions of the strips to hold the files placed in the drawer.

FIG. 8 shows a reenforcing feature which is applicable to the transverse ridges 14 in all the modifications shown. Rigid plastic or metal reenforcing elements 28 are fixed within the plastic mat to have upstanding portions 29 to enhance the firmness of the ridges 14. The portions 29 may take many shapes such as upstanding pegs or a continuous linear element. The exact shape of the reenforcing element is not critical.

FIG. 9 shows an optional feature to adapt the file holding mat to certain cabinet drawers provided with depressions or elevations on the bottom surface thereof. Supporting ridges 30 in this instance are placed longitudinally on the bottom surface of the mat facilitating the conforming of the mat to the depressions or elevations present. The mat is flexible and may be rolled up to facilitate storage in a tube.

Figure 10:
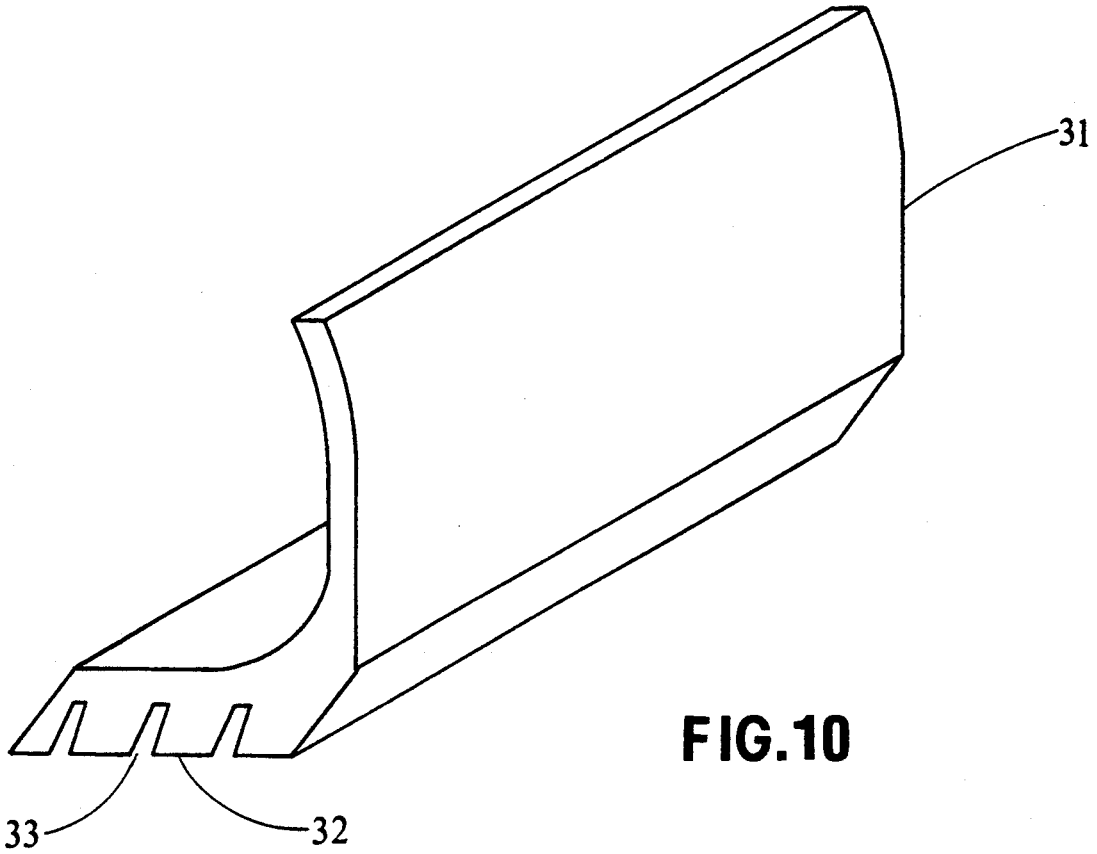
FIG. 10 illustrates a back stop which can be used with all the mat modifications.

FIG. 10 shows a backstop 31 which may be employed with all of the mat modifications shown. The backstop 31 is made of a firmer material than the mat and may be placed behind the last file to keep the group of files compacted together to prevent the group from sliding to the unused back portion of the file drawer. The ridged bottom surface 32 of the backstop is a negative image matching the ribbed surface 14 of the file mat with the ridges 14 being received within the spaces 33. The backstop 31 may be lifted by one hand and inserted over the ridges 14 on the file mat at any desirable position to secure a folder group.

Figure 11:
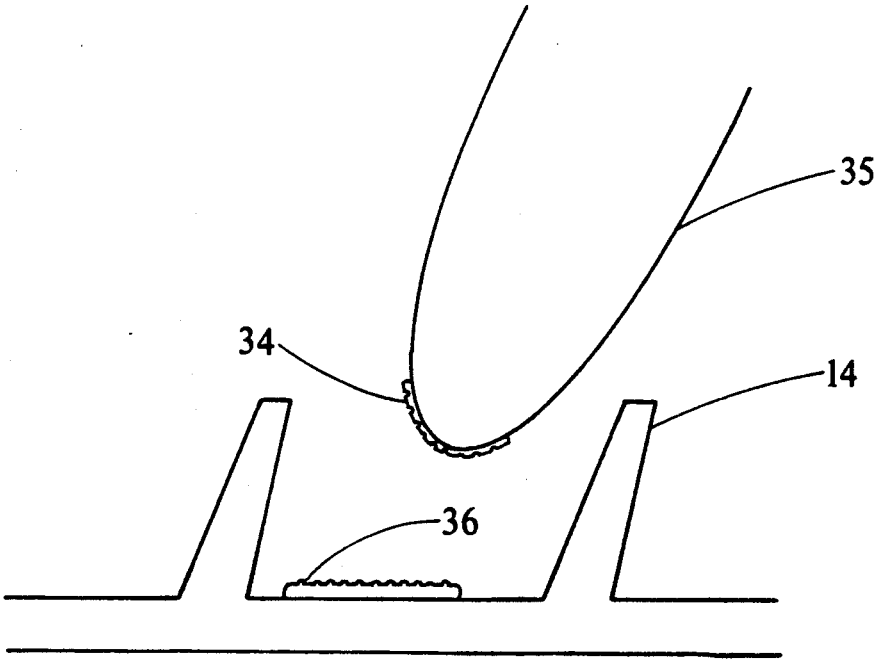
FIG. 11 shows a security seal between the mat and a stored folder.

FIG. 11 shows a security feature easily adaptable to the file mat of the invention. A tamper resistant seal 34 with an adherent material is placed along the exterior folding portion of a file folder 35. When the file folder is placed upon the mat between the ridges 14, the outer surface of the seal adheres to the mat. As the folder is lifted off the mat the seal is broken with a gradual change in color on the detached portion 36 of the seal indicating prior removal of the file and its replacement.

Figure 12:
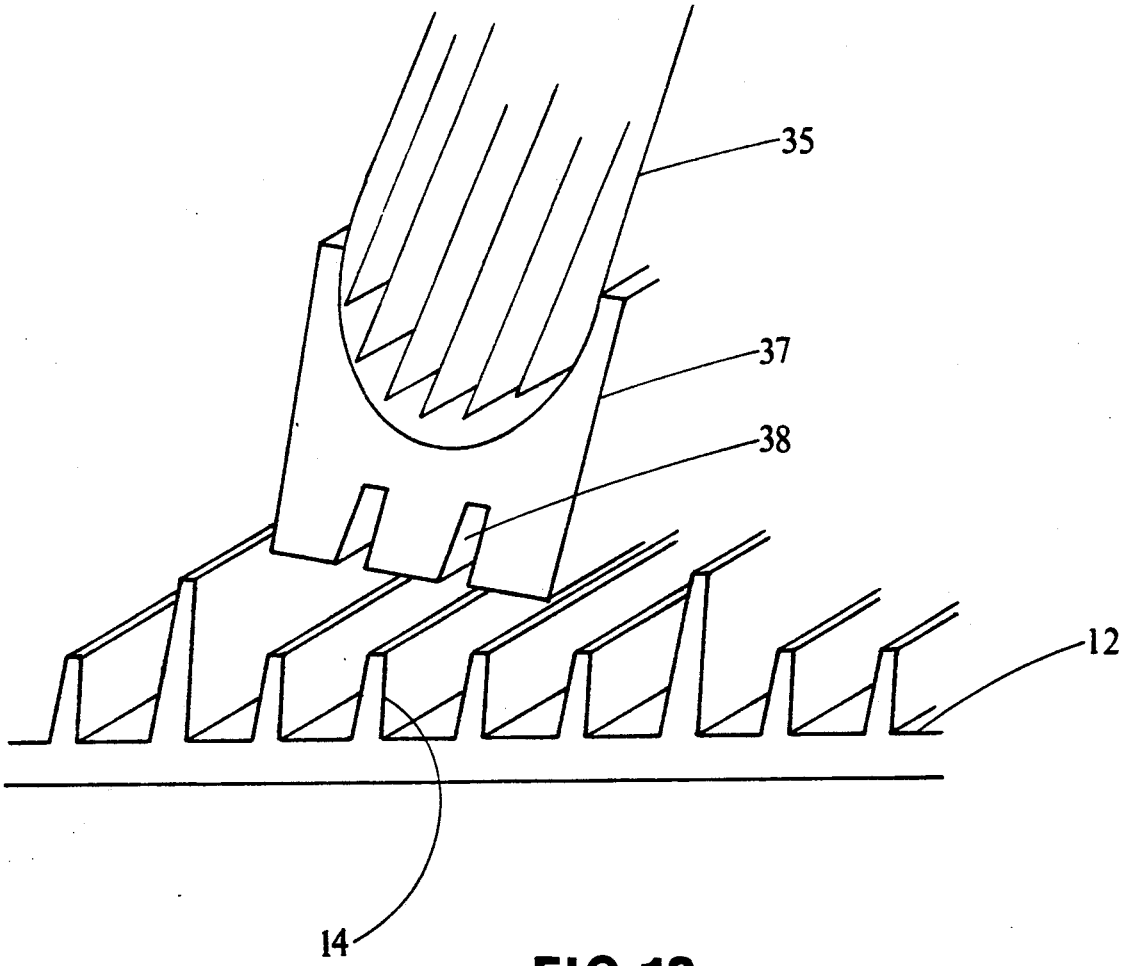
FIG. 12 shows a support for a manila folder with bottom slots which mate with ridges on the mat.

FIG. 12 shows a filing accessory useful with the disclosed file mats. A flexible plastic type binder 37 is secured to the outer surface of the file holder 35 along its folded seam. This reduces the fatigue and tearing of the two leaves of the folder which tends to occur at the fold with frequent handling of the folder. The outer surface of the plastic binder 37 has grooves 38 matching the ridges 14 of the filing mat 12 further preventing slippage of the file folder.

In operation, the mat is placed flat upon the file drawer bottom with the elevated ridges 14 facing upwards and oriented transversely to the pull axis of the drawer. Each transverse ridge projects upward vertically or at an incline to facilitate the separation of the folders and to resist the sliding of these folders backward and into a horizontal position in the drawer due to the weight and suppleness of the folders. Larger or firmer ridges 16 which may be present as an integral portion of the file mat are periodically positioned among the primary ridges to facilitate separation of desired folder groups. A fine, slightly elevated topographical pattern may additionally be present on the mat to increase the surface coefficient of friction on the bottom to retard slippage of the file mat along the file drawer. The same pattern may be applied between the ridges to prevent slippage of individual folders. Adhesive material may also be placed uniformly or in a topographical pattern upon the bottom surface to secure the mat to the file drawer.

It is not intended to limit the present invention to the details of illustration or terms of description of the embodiments shown above. It will be appreciated by those skilled in the art that various modifications and alterations therein may be made within the scope of the present invention.

What is claimed is:

1. In combination with a filing cabinet having at least one sliding drawer, said sliding drawer having a generally flat bottom floor to support a plurality of edge mounted files in a generally upright position, means to prevent said edge mounted files from collapsing away from said upright position due to the weight and suppleness of the files, said means to prevent collapsing comprising a flexible, foldable mat formed of a soft pliant plastic material having a large coefficient of sliding friction, said mat having a generally flat bottom surface and top surface, said bottom surface arranged to lie flat on said bottom floor such that the entire bottom surface contacts the bottom floor in a skid resistant manner; and a plurality of spaced, parallel primary ridges on said mat top surface, the spaces between said ridges forming grooves to receive said edge mounted files.

2. The combination as claimed in claim 1 wherein said ridges are angled in the direction of the front of the drawer.

3. The combination as claimed in claim 2 including a divider of firmer material than said mat, said divider having a planar upstanding wall acting as a backstop for said files and a foot portion angularly extending from a base portion of said wall, said foot portion having a ribbed surface which is the negative image of the ribbed surface of said mat whereby said divider may be meshed with said mat at a selected location to isolate a portion of said file cabinet drawer.

4. The combination as claimed in claim 2 including rigid stiffeners inserted in said mat, each said stiffener having a portion extending into a ridge to strengthen same.

5. The combination as claimed in claim 1 wherein said mat is provided with score lines on said bottom and top surfaces to adjust the size of the mat.

6. The combination as claimed in claim 1 wherein larger or firmer ridges are positioned periodically among the primary ridges to facilitate separation of desired file groups.

7. The combination as claimed in claim 1 wherein said mat may be rolled up and secured in a tight cylinder for storage or shipping.

8. The combination as claimed in claim 1 wherein said generally flat bottom floor is provided with spaced depressions and said bottom surface of said mat contains supporting ridges conforming to said depressions.

9. The combination as claimed in claim 1 wherein said flexable mat comprises two spaced longitudinal strips joined by a bridging section, said bridging section located at the rear end of the drawer; and said ridges being located on said bridging section and said longitudinal strips.

10. The combination as claimed in claim 1 wherein said flexable mat comprises two spaced longitudinal strips, each strip comprising an upstanding wall abutting a side portion of said drawer and a right angular extension lying flat on said drawer floor, said ridges formed on said right angular extensions.

11. The combination as claimed in claim 1 including an adhesive applied to the bottom surface of said mat.

12. The combination as claimed in claim 1 wherein said file is a file folder including a tamper resistant seal for said folder, said tamper resistant seal comprising as adherent placed on said file folder at the folding portion whereby when said folder is placed on said file mat between a pair of ridges an adhesive bond is formed between said folder and mat, removal of said folder breaking said bond with subsequent color change of said adhesive on said mat indication a removal of said folder.

13. The combination as claimed in claim 1 wherein said file is a file holder, said file holder including a flexible, plastic, generally U-shaped reenforcing member secured to the base of the file holder around its folding seam, the bottom of said U-shaped member being provided with spaced ridges which mesh with the ridges in the mat.

14. The combination as claimed in claim 13 wherein larger or firmer ridges are positioned periodically among the primary ridges to facilitate separation of desired file groups and said ridges on said U-shaped member mesh with a plurality of primary ridges located between said larger ridges.

* * * * *